United States Patent [19]

Grime

[11] 4,433,812

[45] Feb. 28, 1984

[54] PAINT SPRAY ATTACHMENT

[75] Inventor: Thomas E. Grime, Temperance, Mich.

[73] Assignee: Champion Spark Plug Company, Toledo, Ohio

[21] Appl. No.: 429,153

[22] Filed: Sep. 30, 1982

Related U.S. Application Data

[62] Division of Ser. No. 205,915, Nov. 12, 1980.

[51] Int. Cl.[3] ..... B05B 7/08; B05B 7/24

[52] U.S. Cl. ..... 239/290; 239/340

[58] Field of Search ..... 239/290, 296, 297, 300, 239/302, 304, 307, 337, 340, 341, 346, 351, 352, DIG. 14, 282, 283; 251/205

[56] References Cited

U.S. PATENT DOCUMENTS

| | | | |
|---|---|---|---|
| 1,409,220 | 3/1922 | Leighty et al. . | |
| 1,460,662 | 7/1923 | Drager et al. . | |
| 2,079,933 | 5/1937 | Fisher | 239/340 X |
| 2,148,535 | 2/1939 | Cone . | |
| 2,526,361 | 10/1950 | Johnson | 251/205 X |
| 2,626,188 | 1/1953 | Dalrymple | 239/290 X |
| 2,755,110 | 7/1956 | Jacobs . | |
| 2,959,358 | 11/1960 | Vork | 239/290 X |
| 3,058,670 | 10/1962 | Marotto et al. . | |
| 3,131,868 | 5/1964 | Coleman . | |
| 3,208,673 | 9/1965 | Kautz . | |
| 3,501,177 | 3/1970 | Jacobs . | |
| 3,637,142 | 1/1972 | Gassaway . | |
| 3,827,635 | 8/1974 | Krakowski et al. . | |
| 3,961,754 | 6/1976 | Kuhns et al. . | |

FOREIGN PATENT DOCUMENTS 318738 9/1929 United Kingdom ..... 239/340

OTHER PUBLICATIONS

Binks Manufacturing Co., Catalog No. 956 A, p. 4, Chicago, Illinois, 60612, Jul. 1966.

Literature on a DeVilbiss Duster Gun Made in Japan for DeVilbiss.

Owner's Manual for the "Thunder Gun Power Washer ®" Model TG1000, made by Briar Industries Inc., Gardner, KS.

*Primary Examiner*—Andres Kashnikow

*Attorney, Agent, or Firm*—Emch, Schaffer & Schaub Co.

[57] ABSTRACT

The disclosure is directed to a paint spray attachment for a compressed fluid gun. The paint spray attachment includes an adapter. One end of the adapter is positioned on the discharge end of the gun and the other end of the adapter defines a discharge opening. A passageway is positioned in the adapter and the passageway is in communication with the aperture in the wall of the adapter. The passageway terminates at the discharge aperture. A chamber is defined in the adapter around the passageway. An air cap is positioned on the end of the adapter. At least one fluid aperture is disposed in the air cap adjacent the discharge aperture in the passageway. The fluid aperture and the chamber are in communication. A cup is positioned in a spaced apart relationship to the aperture in the wall of the adapter. A bracket is provided for attaching the cup to the handle of the spray gun wherein the bracket is removably positioned in the handle cavity of the gun.

12 Claims, 13 Drawing Figures

PAINT SPRAY ATTACHMENT

This application is a division of application Ser. No. 205,915, filed Nov. 12, 1980.

BACKGROUND OF THE INVENTION

The present invention is directed to a spray gun for delivering a compressible fluid from a discharge opening in the spray gun. The invention is also directed to a number of attachments that can be positioned on the spray gun to allow the spray gun to be utilized for different purposes.

Spray guns have been used in the prior art for dispensing different materials. Normally the spray guns are connected to a source of compressed air, such as a compressor, and the compressed air is used to dispense a material. Spray guns have normally contained a movable valve that is used to control the flow of compressed air through the spray gun. The compressed air generally moves through a discharge nozzle located on the spray gun and as the compressed air moves through the discharge nozzle it dispenses the material being handled by the spray gun. The material being dispensed by the spray gun is normally supplied to the spray gun in the region of the discharge nozzle.

Prior art spray guns are normally designed for a particular end use; such as spray painting. Different nozzles may be supplied with the spray gun for varying the pattern in which the material is dispensed from the spray gun but these different nozzles do not alter the basic purpose for which the spray gun was constructed.

Prior art spray guns have a needle valve located in the paint supply passageway for providing positive control to the supply of paint to the spray gun. The needle valve is displaced by the displacement of the trigger on the spray gun. The displacement of the needle valve allows paint to flow to the discharge end of the spray gun. When the trigger is released the needle valve is biased to cause the valve to close and shut off the flow of paint to the spray gun. The needle valve and trigger are arranged so that when the trigger is displaced air flows to the spray gun before the needle valve is displaced to allow paint to flow to the discharge end of the spray gun. When the trigger is released the needle valve closes and shuts off the flow of paint to the spray gun before the air flowing to the spray gun is shut off. The needle valve to control the paint supply and the operational sequence for the needle valve have been thought necessary to produce an acceptable spray pattern for a spray gun.

The prior art spray guns also do not have good controls for the supply of compressed air to the spray gun. When the trigger mechanism is displaced the compressed air is supplied to the gun until the trigger mechanism is released and the supply of compressed air is shut off. There is usually no provision in the trigger mechanism to regulate the supply of compressed air. Instead the trigger mechanism just provides an on-off type of control for the supply of compressed air to the spray gun.

There is a need for a spray gun that can be adapted for a number of end uses. Principally there is a need for a spray gun that will accept various attachments or nozzles that will allow the end use of the spray gun to be varied. In particular it is desirable to have a spray gun that is capable of discharging gases, liquids or particulate solids. In addition, there is a need for a spray gun that does not require a needle valve in the paint supply passageway to provide positive control for the supply of paint to the spray gun. Further it is desirable to have a spray gun where the supply of compressed air to the spray gun can be regulated.

SUMMARY OF THE INVENTION

According to the invention there is provided a gun for supplying a compressed fluid comprising a housing defining a passageway for supplying a compressible fluid. A valve means is moveably positioned with respect to said passageway for controlling the supply of the compressible fluid. The valve means defines an aperture and the valve means is moveable with respect to the passageway to vary the position of the aperture with respect to the passageway to control the supply of the compressible fluid. A discharge end is located on one end of the passageway. The discharge end is adapted to receive discharge nozzles for the gun whereby the compressible fluid acts as a driving fluid for different driven fluids or solids.

There is also provided according to the invention a number of attachments which can be utilized with the gun of the present invention.

A spray attachment for a gun for supplying a compressed fluid comprising a substantially cylindrical adapter is disclosed. One end of the adapter is positioned on the discharge end of the gun and the other end of the adapter defines a discharge opening. An aperture is defined in the wall of the adapter. A passageway is positioned in the adapter and the passageway is in communication with the aperture in the wall of the adapter. The passageway terminates in the discharge aperture. A chamber is defined in the adapter around the passageway. An air cap is positioned on the end of the adapter and the air cap extends from the periphery of the adapter to the discharge aperture in the passageway. At least one aperture is disposed in the air cap adjacent the discharge aperture in the passageway. The aperture defines a path of communication between the chamber and the discharge opening in the adapter. A source of paint or other suitable liquid is positioned in communication with the aperture in the wall of the adapter.

A washing attachment for a gun for supplying a compressed fluid comprising a substantially cylindrical conduit that defines a passageway is also disclosed. One end of the conduit is positioned on the discharge end of a gun for supplying a compressed fluid. A channel is positioned in the passageway at the other end of the conduit. One end of the channel terminates in an aperture. A valve means is movably positioned in the channel. One end of the valve means is capable of matingly engaging the portion of the channel adjacent the aperture. A source of cleaning material is positioned in communication with the aperture in the channel. An elongated member is connected to the conduit on the opposite side of the channel. The elongated member defines a first, a second and a third passageway. The first passageway is in communication with the channel in the conduit. The second passageway is in communication with the passageway defined by the conduit. The elongated member terminates in a discharge opening. The first, second and third passageways terminate in discharge apertures that are adjacent the discharge opening for the elongated member. An opening is defined in the wall of the elongated member. The opening is in communication with the third passageway in the elongated member. The opening is disposed for connection to a source of water.

The invention also includes a blasting attachment for a gun for supplying a compressed fluid comprising a substantially cylindrical adapter where one end of the adapter is positioned on the discharge end of the gun. An air tip is positioned in the adapter adjacent the discharge end of the gun. The air tip extends from the outer periphery of the adapter in a generally converging direction towards the center of the adapter. The air tip defines a discharged nozzle that is located substantially in the center of the adapter. A chamber is located in the adapter around the air tip. The chamber is in communication with the discharge nozzle in the air tip. An aperture is defined in the cylindrical adapter and the aperture is in communication with the chamber in the adapter. The aperture in the adapter is disposed for connection to a source of particulate blasting material. A blasting nozzle is positioned on the end of the adapter that is spaced apart from the gun. The blasting nozzle defines a passageway. One end of the passageway is positioned in alignment and in spaced apart relationship with the discharged nozzle in the air tip. The other end of the blasting nozzle defines a discharge aperture.

Further disclosed is a duster attachment for a gun for supplying a compressed fluid comprising a substantially cylindrical adapter and one end of the adapter is positioned on the discharge end of the gun. The other end of the adapter terminates in a discharge opening. The interior of the adapter defines a chamber. A generally converging wall portion is positioned in the adapter. The converging wall is positioned at the end of the adapter adjacent the discharge end of the gun. The converging walls define a nozzle having a discharge aperture and the discharge aperture is in communication with the chamber in the adapter.

DESCRIPTION OF THE PREFERRED EMBODIMENTS

Figures 1, 1A, 2:
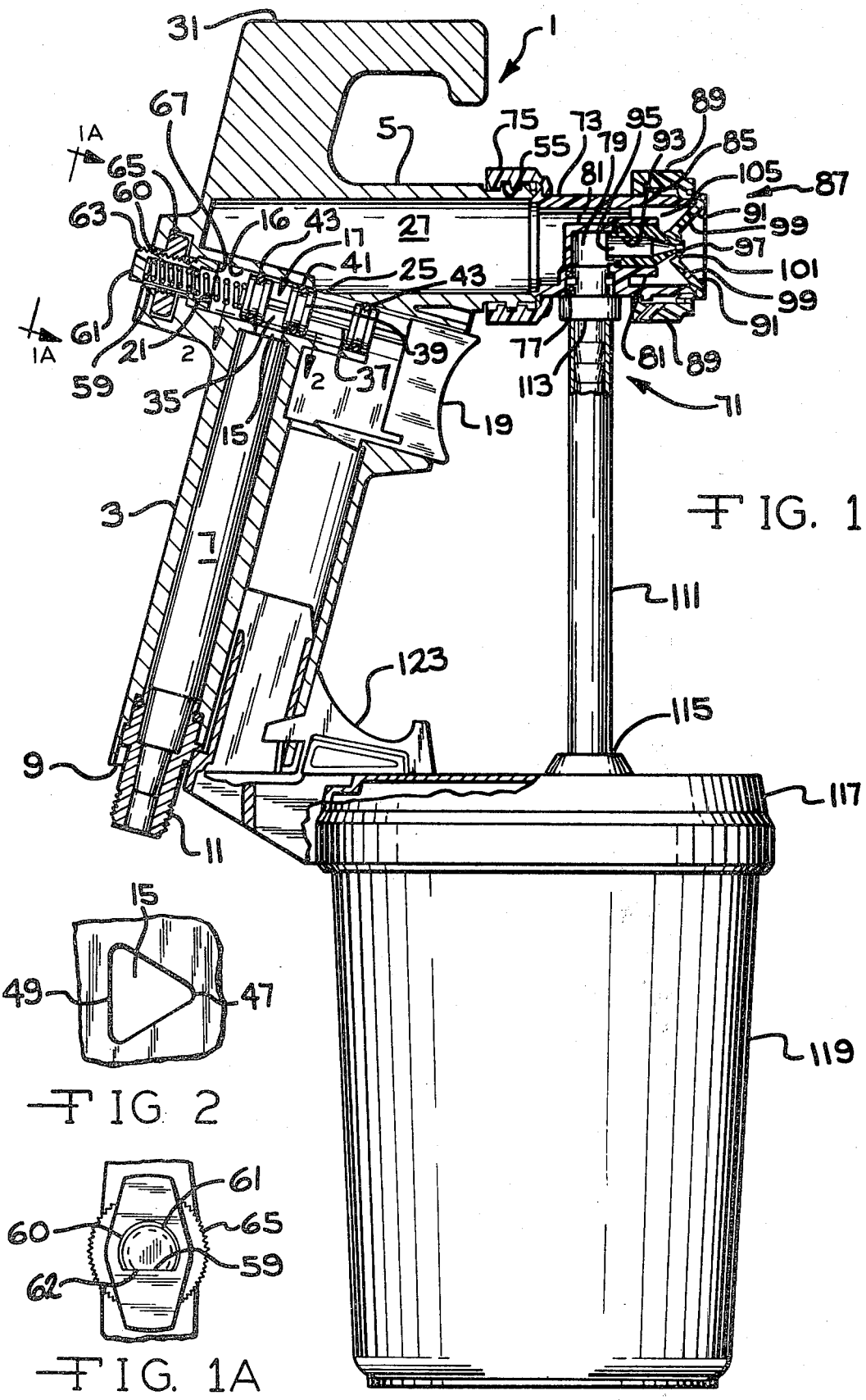
FIG. 1 is a side elevation view, partially broken away, of the gun for supplying compressed fluid of the present invention with a paint spraying attachment connected to the gun.
FIG. 1A is a cross sectional view taken along line 1A—1A in FIG. 1.
FIG. 2 is a cross sectional view taken along line 2—2 in FIG. 1.
Figures 3, 3A, 4:
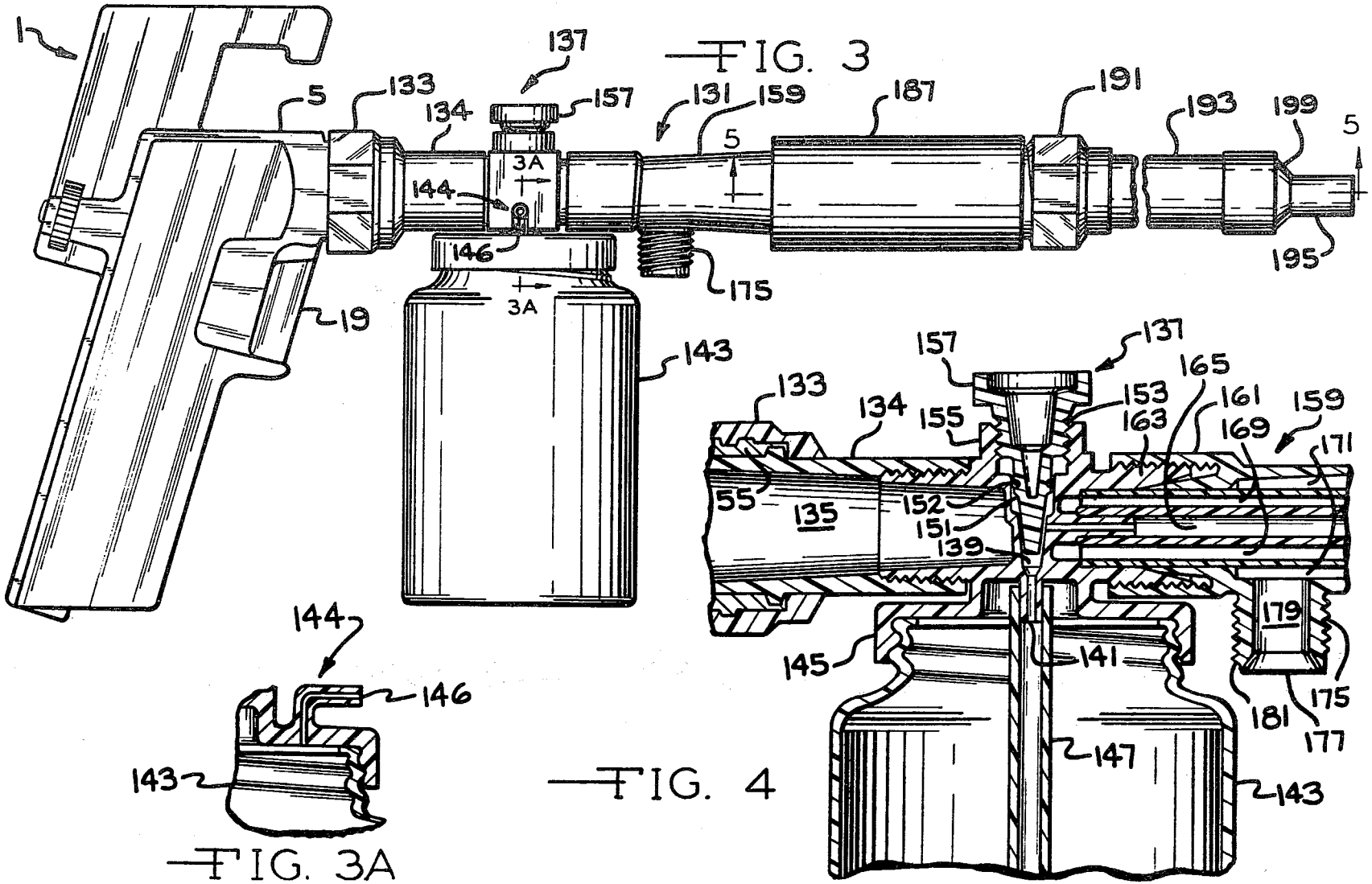
FIG. 3 is a side elevation view of the gun of the present invention with a washing attachment connected to the gun.
FIG. 3A is a cross sectional view taken along 3A—3A in FIG. 3.
FIG. 4 is a partial cross sectional view of the washing attachment shown in FIG. 3.
Figure 5:
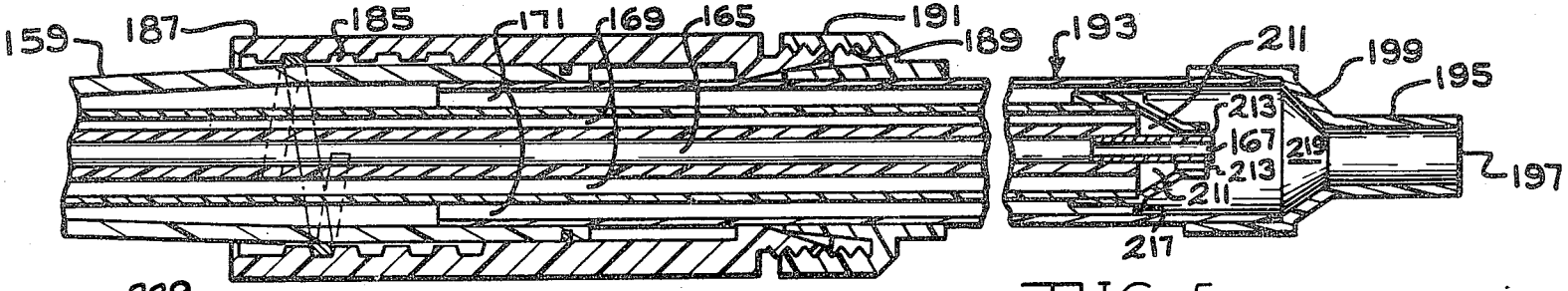
FIG. 5 is a cross sectional view of the washing attachment taken along 5—5 in FIG. 3.

The present invention relates to a gun for supplying compressed fluid. Details of the invention will be more readily understood by referring to the attached drawings in connection with the following description.

The gun for supplying compressed fluid 1 has a handle 3 and a barrel 5. The handle 3 defines a passageway 7. The inlet end 9 of the passageway 7 has a connector 11 positioned therein. The connector 11 can be connected to a suitable source of fluid (not shown). Normally air under pressure will be supplied to the connector. The discharge end of the passageway 7 contains an aperture 15. The aperture 15 connects the passageway 7 to a bore 16 in the body of the gun. A spool valve 17 is slideably positioned in the bore 16. One end of the spool valve 17 is connected to a trigger mechanism 19. Movement of the trigger mechanism 19 controls the movement of the spool valve 17 in the bore 16. On the opposite end of the spool valve is a spring means 21 which biases the spool valve toward the trigger mechanism 19.

On the opposite side of the spool valve 17 from the aperture 15 there is a port 25. The port 25 is in communication with a passageway 27 located in the barrel 5 of the gun. The passageway 27 terminates in a discharge opening 29. The gun can also be provided with a hook 31 which can be used to hang the gun.

The spool valve 17 contains an obstruction section 35 that blocks the flow of fluid through the aperture 15. The spool valve 17 has an open section 37 that allows communication between the aperture 15 and the port 25. A wall 39 is positioned between the obstruction and the open sections of the spool valve. An O-ring seal 41 is positioned on the wall 39 to effectively seal the obstruction section 35 from the open section 37 of the spool valve 17. O-rings 43 can also be positioned at each end of the spool valve to provide seals at the end of the spool valve.

The spring means 21 biases the spool valve 17 towards the trigger mechanism 19 so that the obstruction section 35 of the spool valve is in alignment with the aperture 15. If the trigger mechanism 19 is moved toward the spring means 21 the spool valve 17 can be displaced so that the open section 37 of the valve is in communication with the aperture 15 and the port 25.

The aperture 15 located at the end of the passageway 7 has a substantially triangular cross section (see FIG. 2). The aperture is positioned so that the apex 47 of the triangular aperture is positioned close to and pointing towards the trigger mechanism 19. The base 49 of the triangular aperture 15 is positioned adjacent the spring means 21. The aperture 15 is positioned so the base 49 is substantially perpendicular to the longitudinal axis of the spool valve 17.

The discharge opening 29 can be provided with a threaded connection 55 positioned round its outer periphery to which a variety of nozzles for the gun can be attached.

Positioned around the end of the spring means 21 that is spaced apart from the spool valve 17 is a movable stop 61. The movable stop terminates in an end 67 that is positioned in the bore 16. The end 67 of the movable stop acts as a barrier surface to restrict the range of travel of the spool valve 17. The other end of the movable stop extends through an aperture 60 in the handle of the gun 1. One side 62 of the movable stop is flat and one side 59 of the aperture 60 is flat. The flat side 62 of the movable stop 61 engages the flat side 59 of the aperture 60. Threads 63 are positioned around the outer periphery of the stop 61. The threads 63 are engaged by a rotatable nut 65 that is positioned in the handle of the gun 1. The position of the end 67 of the movable stop 61 is controlled by the rotation of the nut 65. The engagement of the flat side of the movable stop with the flat section in the bore prevents the stop from rotating in the bore. Accordingly, as the nut is rotated the stop 61 will be advanced in the bore 16.

In operation the connector 11 at the inlet end 9 of the passageway 7 will be connected to a source of air under pressure. The compressed air passes through the connector 11 into the passageway 7. The compressed air will remain in the passageway 7 as long as the obstruction section 35 of the spool valve 17 is in alignment with the aperture 15 as the obstruction section effectively seals the aperture 15. If the trigger mechanism 19 is displaced towards the spring means 21 the spring means 21 will be compressed and the wall 39 of the spool valve will be moved towards the aperture 15. When the open section 37 of the spool valve 17 comes into communication with the aperture 15 and the port 25. Accordingly, compressed air will be able to flow through the aperture 15, through the open section 37 of the spool valve, through the port 25 and into the passageway 27 located in the barrel 5 of the gun. The compressed air can then be discharged through discharge opening 29 located at the end of the gun.

As the trigger mechanism 19 is displaced towards the spring means 21 a larger portion of the aperture 15 will come into communication with the open section 37 of the spool valve 17. The triangular configuration and position of the aperture 15 results in a larger and larger cross section of the aperture 15 to come into communication with the open section 37 as the spool valve 17 moves toward the spring means 21. Accordingly, the flow of compressed air through the aperture 15 will progressively increase as the trigger mechanism 19 is displaced towards the spring means 21 until the aperture 15 is in complete communication with the open section 37 of the spool valve 17.

When the trigger mechanism 19 is released the spring means 21 will cause the spool valve to be biased towards the trigger mechanism 19. Thus, the spool valve will move towards the trigger mechanism 19 until the aperture is in alignment with the obstruction section 35 of the valve and the aperture 15 is closed. As the spool valve 17 moves towards the trigger mechanism 19 the flow of air through the aperture 15 will be progressively decreased due to the triangular configuration and the position of the aperture 15.

The triangular configuration of the aperture 15 and the inter relation between the spool valve 17 and the aperture allows the flow of the compressed fluid to the gun to be very precisely controlled. Accordingly, the quantity or volume of the compressed fluid can be controlled by positioning the trigger to achieve the desired relationship between the triangular aperture 15 and the spool valve 17. In addition, the pressure of the compressed fluid being discharged from the discharge opening 29 in the barrel 5 of the gun can be controlled by controlling the flow of the compressed fluid through the aperture 15. Therefore, the pressure of the compressed fluid being discharged from the discharge opening 29 can be controlled without changing the pressure setting on the compressor supplying the compressed fluid.

The movable stop 61 can be used to control the range of movement of the spool valve 17. The end 67 of the stop 61 can be varied in position by rotating the nut 65 which engages the threads 63 on the stop 61. As the trigger mechanism is displaced towards the spring means 21 the spool valve will move towards the movable stop 61 until the end of the spool valve engages the end 67 of the stop 61. Thus, if the stop 61 is advanced towards the trigger mechanism 19 the displacement of the spool valve 17 towards the spring means 21 will be restricted. If the stop 61 is advanced away from the trigger mechanism 19 to the full extent the spool valve 19 will be free to move to its complete extent towards the spring means 21. The advantage of the movable stop 61 is that the stop can be positioned so the end 67 causes the spool valve to displaced only to the desired extent. During the use of the gun a particularly desirable level of flow of the compressed fluid through the gun may be achieved. When this condition is achieved the nut 65 can be rotated so that the end 67 of the movable stop 61 will come in contact with the end of the spool valve 17. In this condition the trigger mechanism can be displaced until the spool valve strikes the end 67 of the stop and the desired flow level will be obtained. As the trigger mechanism cannot be displaced any further the trigger mechanism just has to be maintained at its position against the end 67 to maintain this desired spray level. If fine tuning of the spray pattern is required, this can be accomplished by rotating the nut 65 while keeping the trigger mechanism 19 fully depressed against the end 67 of the stop. The rotation of the nut 65 will vary the position of the spool valve with respect to the aperture 15 and change the volume of flow of compressed air through the aperture 15.

As shown in FIG. 1 a paint spray attachment 71 has been connected to the gun 1. The paint spray attachment has an adapter 73 which engages the threaded connection 55 on the barrel 5 of the gun. An aperture 77 is defined in the bottom of the adapter 73. The aperture 77 is in communication with a passageway 79 which is located in the interior of the adapter 73. The passageway 79 is defined by walls 81 which extend into the adapter 73.

A threaded connection 85 is positioned on the exterior of the adapter 73 in a position that is spaced apart from the discharge opening 29 in the barrel 5. An air cap 87 is positioned in the discharge end of the adapter 73. The air cap 87 is held in place by a quick release locking means 89 which engages the threaded connection 85 on the adapter 73. The air cap 87 has a member 91 which projects into the center of the adapter 73. The member 91 is connected to a nozzle 93 which is positioned in engagement with the walls 81 of the passageway 79. The nozzle 93 defines a passageway 95 which is in communication with the passageway 79. A discharge aperture 97 is located at the end of the passageway 95 immediately adjacent the member 91.

The member 91 defines a first set of apertures 99 and a second aperture 101 positioned around the periphery of the nozzle 93. The apertures 99 and 101 are in communication with cavity 105 which is formed between the walls of the adapter 73 and the walls 81 of the passageway 79. The cavity 105 is in communication with the discharge opening 29 in the barrel 5 of the gun 1.

One end of a hose 111 is positioned in the aperture 77. The hose is secured to the aperture by means of a connector 113. The other end of the hose 111 passes through an aperture 115 located in the top 117 of a cup 119. The hose 111 normally extends substantially to the bottom of the cup 119. The top 117 is normally removably secured to the cup 119. A vent (not shown) is usually provided in the top to place the interior of the cup in communication with the atmosphere.

A bracket 123 is secured to one side of the top 117 of the cup 119. The bracket 123 is also removably secured to the handle 3 for the spray gun 1. The bracket 123 supplies a support which connects and supports the cup 119 with respect to the gun 1.

The operation of the paint spray attachment will be more readily understood by referring to FIG. 1 in connection with the following description. Paint or similar material is positioned in the cup 119. The hose 111 is positioned in the aperture 115 in the top 117 so that the hose extends into the cup 119. The top 117 is then secured to the cup 119 and the cup is secured to the handle 3 of the gun by means of the bracket 123. The hose 111 is then secured to the aperture 77 in the adapter 73 by means of connector 113. The vent in the cap prevents a vacuum from being created in the cup that would prevent the flow of paint from the cup. The gun is then ready to spray paint of similar material.

Compressed air is allowed to flow through the passageway 7 into the passage 27 in the barrel 5 by activating the trigger mechanism in the manner previously described. The compressed air will pass through the discharge opening 29 in the barrel 5 and enter the adapter 73. The compressed air will enter the cavity 105 formed between the walls of the adapter 73 and the walls 81 of the passageway 79. The compressed air will be discharged through the first set of apertures 99 and the second aperture 101 located in the members 91. The flow of the compressed air from the aperture 101, which is immediately adjacent the discharge aperture 97 in the nozzle 93, will create a zone of reduced pressure around the discharge aperture 97. The zone of reduced pressure will create a reduced pressure in the passageway 95 and the nozzle 93, in the passageway 79 and in the hose 111. The reduced pressure will cause paint to flow from the cup 119 into the hose 111 through the passageway 79 through the passageway 95 and the nozzle 93 and be discharged from the discharge aperture 97. As the paint or similar material leaves the discharge aperture 97 it will be engaged by the compressed air passing from the aperture 101. As the paint or similar material moves from the discharge aperture 97 it will also be engaged by the compressed air issuing from the apertures 99 located in the member 91. The position of the apertures 99 and the compressed air from the apertures 99 can be used to achieve a desired spray pattern for the paint issuing from the spray paint attachment 71.

The paint spray attachment is controlled by the supply of compressed air to the gun. The paint is drawn into the spray attachment in response to the reduced pressure in the passageway 95 in the nozzle 93 created by the flow of compressed air from the aperture 101 which is immediately adjacent the discharge aperture 97 in the nozzle 93. The extent of the reduced pressure is directly proportional to the volume and pressure of the compressed air being discharged from aperture 101. As the quantity and pressure of the compressed air being discharged from aperture 101 increases the reduction in pressure around the discharge aperture 97 also increases. Accordingly, the increased pressure reduction causes more paint to be drawn from the cup 119 and discharged from the discharge aperture 97. If the pressure and volume of the compressed air being discharged from aperture 101 is reduced there is not as large of a reduction of pressure around the discharged aperture 97 and not as much paint will be drawn from the cup 119 into the discharge aperture 97. Changes in the pressure and volume of compressed air supplied to the spray attachment also effects the discharge of compressed air through the apertures 99. Accordingly, the discharge of compressed air through the apertures 99, which help to establish the spray pattern for the paint issuing from the spray paint attachment, is also varied to be compatible with the quantity of paint being discharged from the discharge aperture 97. From the above it is clear that controlling the supply of compressed air acts to completely control the output of paint and the spray pattern of the spray attachment 71. The control is also self regulating as the supply of paint to the spray attachment and the spray pattern produced by the spray attachment are directly dependent upon the quantity and pressure of the compressed air supplied to the spray attachment. Therefore, as the quantity and pressure of the supply of compressed air are varied the quantity of paint supplied to the spray attachment and the spray pattern produced are varied in response to the change in the supply of compressed air. It is significant that the supply of compressed air can be controlled by controlling the movement of the trigger mechanism on the gun. Accordingly, the output of paint and the spray pattern of the spray attachment are controlable by controlling the supply of compressed air delivered to the spray attachment.

FIGS. 3, 3A, 4 and 5 show a washing attachment 131 that can be connected to the gun 1. The washing attachment attaches to the discharge opening of the barrel 5 of the gun. A connector 133 can be used to secure the washing attachment to the threaded connection 55 located on the end of the barrel for the gun. The washing attachment comprises a conduit 134 defining a passageway 135 which is in communication with the previously discussed passageway 27 in the barrel 5 of the gun.

A valve means 137 is positioned in the passageway 135. The valve means defines a channel 139 and the channel terminates in an aperture 141. A cup 143 is positioned around the aperture 141 to the channel 139. The cup 143 can be held in position by a cap means 145 which is attached to the conduit 134 of the washing attachment 131. A vent 144 is provided in the cap 145. The vent defines a vent passageway 146. One end of the vent passageway is in communication with the atmosphere and the other end of the vent passageway is in communication with the interior of the cup 143 when the cup 145 is secured to the cap. A tube 147 is positioned around the aperture 141 and extends into the cup 143. The tube extends to substantially the bottom of the cup 143.

A valve 151 is rotatably positioned in the channel 139. An O-ring seal 152 is positioned on the valve 151 to act as a seal between the valve and the channel 139. One end of the valve 151 is designed to seat in the channel 139 to stop the flow of material through the aperture 141 into the channel 139. The other end of the valve 151 contains a threaded portion 153 which engages a threaded collar 155 on the conduit 134. The threaded portion 153 of the valve 151 terminates in a knob 157.

An elongated member 159 is attached to the conduit 134. The elongated member 159 can contain a threaded collar 161 which engages a threaded portion 163 on the conduit 134. The elongated member 159 defines a passageway 165 which is located substantially in the center of the member. The passageway 165 is in communication with the channel 139 in the valve means 137.

The elongated member 159 also defines a passageway 169. The passageway 169 is in communication with the passageway 135 which is in communication with the passageway 27 in the barrel 5 of the spray gun 1.

The elongated member 159 also defines a passageway 171. The passageway 169 is coaxial with the passageway 165 and the passageway 171 is coaxial with the passageway 169 and the passageway 165. Accordingly, the passageway 165 is located in substantially the center of the elongated member 159, the passageway 171 is located adjacent the outer wall of the elongated member 159 and the passageway 169 is located intermediate the passageway 171 and the passageway 165.

The elongated member 159 has a member 175 positioned on the exterior of the elongated member. The member defines an opening 177 at the end thereof and a passageway 179. The passageway 179 is in communication with the passageway 171 located in the elongated member 159. The exterior of the member 175 contains threads 181. The member 175 is normally connected to a source of water or other fluids that can be used in the washing attachment 131.

The elongated member 159 has a threaded portion 185 located at substantially the end of the elongated member. A threaded collar 187 is positioned around the periphery of the elongated member 159 to engage the threaded portion 185. The other end of the threaded collar 187 contains a threaded portion 189 which engages a threaded connector 191. The threaded connector 191 is connected to tube 193. The tube 193 is essentially an extension of the elongated member 159 and the tube forms the outer housing for the passageway 171, passageway 169 and passageway 165. The tube terminates in a discharge section 195 having a discharge opening 197. The discharge section 195 has a smaller diameter than the diameter of the tube 193. A converging section 199 is used to connect the smaller diameter discharge section 195 to the tube 193. The passageway 165 terminates in a discharge opening 167 that is located adjacent the discharge section 195 of the tube 193.

Rotation of the threaded collar 187 will cause the elongated member 159 to move with respect to the tube 193. Thus, the rotation of the threaded collar 187 will vary the length of the washing attachment 131. In effect, this will cause the discharge section 195 of the tube 139 to move with respect to the discharge opening 167 in the passageway 165 located in the center of the elongated member.

The passageway 171 terminates in an aperture 217 which is substantially adjacent the chamber 211. The aperture 217 is positioned at an angle so that the surface of the aperture can matingly engage the converging section 199 of the tube 193. The discharge opening 167 for passageway 165, the discharge aperture 213 for passageway 169 and the aperture 217 for passageway 171 all terminate in cavity 219 located in the tube 193. The cavity 219 is in communication with the discharge opening 197 from the tube 193.

The operation of the washing attachment 131 will be more completely understood by referring to FIGS. 3, 3A, 4 and 5 in connection with the following description. Compressed air is supplied to the gun 1 and passes through the gun by activating the trigger mechanism 19 as previously described. The compressed air is then discharged through the discharge opening 29 in the end of the barrel 5 of the gun. As the compressed air leaves the barrel of the gun it enters the passageway 135 in conduit 134. The compressed air will flow around the valve means 137 and enter conduit 169 which is in communication with passageway 135. The compressed air will advance through passageway 169 and into chamber 211 located at the end of the passageway 169. The compressed air will then pass through discharge aperture 213 located in the chamber 211. The discharge aperture 213 is located adjacent the discharge opening 167 for passageway 165. As the compressed air exits discharge aperture 213 it will create a region of reduced pressure being established in the passageway 165. Since the passageway 165 is in communication with channel 139 a zone of reduced pressure will also be established in channel 139. The reduced pressure in tube 147 will cause soap or other material from the cup 143 to be drawn into the tube 147 and into the channel 139. From the channel 139 the soap will pass into the passageway 165 and will be discharged through the discharge opening 167.

The flow of the soap from the cup 143 is controlled by valve means 137. As the knob 157 is rotated the threaded portion 153 of the valve 151 will be caused to advance in the threaded collar 155. The valve 151 can either advance towards or away from the aperture 141. If the valve advances away from the aperture 141 more of the channel 139 will be exposed and a larger quantity of soap from the cup 143 will be able to flow through the channel 135 into the passageway 165. If the valve 151 is advanced towards the aperture 141 the valve 151 will fill most of the channel 139 and restrict the flow of soap from the channel 139 into the passageway 165. If the valve 151 is advanced all the way towards the aperture 141 it will seat with the end of the channel 139 and completely cut off the flow of soap from the cup 143 into the channel 139. Therefore, by positioning the valve 151 in the channel 139 the flow of soap from the cup 143 into the passageway 165 can be controlled.

For the soap to flow from the cup 143, the cup must be vented to prevent a vacuum from being formed in the cup. Therefore, the vent 144 is essential for the proper supply of soap to the washing attachment. The vent can also be connected to a secondary source of soap (not shown) if desired. In this application, soap will be drawn from the secondary source into the cup 143 where the soap will be dispensed as desired to the washing attachment. Connecting the vent to a secondary source of soap allows the washing attachment to be used without stopping to refill the cup with soap.

Water can be supplied to the washing apparatus attachment 131 through opening 177 located in member 175. The water will pass through the opening 177 and into the passageway 179. Passageway 179 is in communication with passageway 171 and the water will therefore flow along passageway 171 until it passes through aperture 217 located at the end of passageway 171. Threads 181 have been provided on the member 175 for connecting a suitable source of water to the member 175.

The water discharged from passageway 171 through aperture 217, the air discharged from passageway 169 through aperture 213 in chamber 211 and the soap discharged through discharge opening 167 in passageway 165 are all combined in cavity 219 located at the end of the tube 193. The water and compressed air will act as a carrying means for the soap and this combination will pass through discharge section 195 and out discharge opening 197. The soap, water and compressed air can then be used for washing objects. The compressed air can be used to impart a higher velocity to the water passing through the discharge opening 197. This velocity can be much higher than the normal velocity of the water passing through passageway 171. The higher velocity for the water increases the effectiveness of the water in removing dirt from the object being washed.

The flow of the water through passageway 171 is controlled by the threaded collar 187 located on the elongated member 159 and tube 193. Rotation of the threaded collar 187 will cause the elongated member 159 to move towards the tube 193. The movement of the elongated member 159 will in effect change the combined length of the elongated member 159 in the tube 193. If the threaded collar 187 is rotated to reduce the combined length of the elongated member 159 and the tube 193 the converging section 199 will be moved towards aperture 217 in passageway 171. As the converging section 199 moves towards the aperture 217 it will restrict the flow of water from the aperture 217. If the threaded collar 187 is rotated far enough the converging section 199 will come into mating engagement with the end of the aperture 217 and completely shut off the flow of water from the passageway 171. If the threaded collar 187 is rotated to cause the combined length of the elongated member 159 and the tube 193 to increase the converging section 199 will move further away from the aperture 217 and more water will be allowed to flow from the passageway 171 through the aperture 217 into cavity 219. Accordingly, the rotation of the threaded collar 187 acts as a valve means to control the flow of water in the washing attachment.

The water and soap supplied to the washing attachment 131 can be completely shut off so that only compressed air will be discharged from the discharge opening 197. The compressed air can be used to clean items that are not suitable for cleaning with soap and water. Therefore, the washing attachment 131 can be used for a number of cleaning operations.

Figure 6:
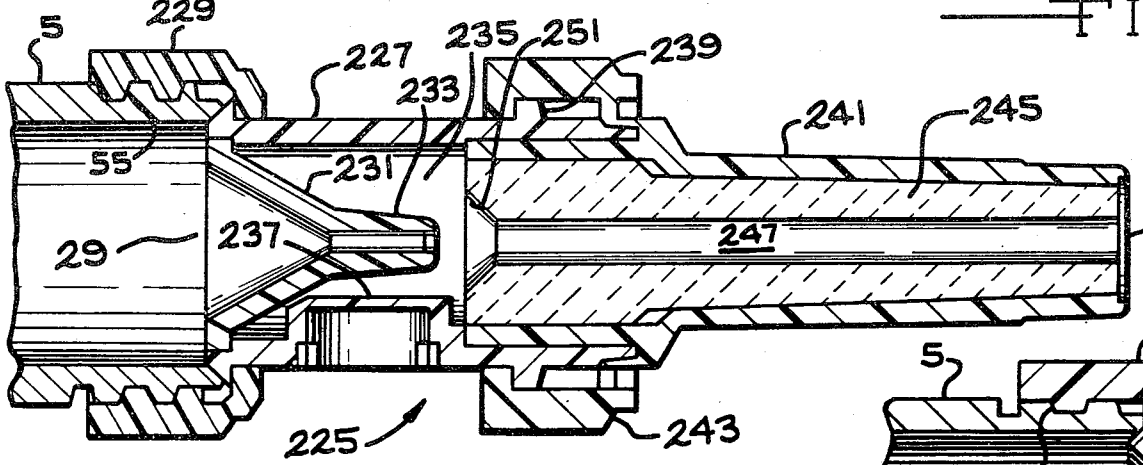
FIG. 6 is a cross section view of a blasting attachment that can be utilized with the gun of the present invention.

FIG. 6 shows the sandblasting attachment 225 which can be used with the gun of the present invention. The sandblasting attachment has an adapter 227 which attaches to threaded connection 55 on the barrel 5 of the gun. A quick connect threaded collar 229 can be provided on the adapter 227 to engage the threaded connection 55 on the barrel 5 of the gun. The adapter 227 is in communication with the discharge opening 29 in the barrel 5 of the gun. An air tip 231 is positioned in the adapter 227. The air tip 231 is conical in shape and extends in a converging fashion from the outer periphery of the adapter 227 to form a discharge nozzle 233. The discharge nozzle 233 terminates in chamber 235. The discharge opening 29 in the barrel 5, through the air tip 231, is in communication with a chamber 235 located in the adapter 227.

An aperture 237 is defined in the walls of the adapter 227 and the aperture is in communication with the chamber 235. The aperture 237 is constructed so that a suitable source of sand or other abrasive material can be connected to the aperture to supply the sand to the chamber 235. An arrangement as shown in FIG. 1 for supplying paint to the gun can also be utilized to supply sand or other abrasive material when using the sand blasting attachment 225.

The adapter 227 has a threaded portion 239 that is spaced apart from the collar 229. A blasting nozzle 241 is positioned in the end of the adapter 227 adjacent the threaded portion 239. A connector 243 can be provided on the blasting nozzle 241 to engage the threaded portion 239 on the adapter 227 to secure the blasting nozzle to the adapter. A protective liner 245 is positioned in the interior of the blasting nozzle 241. The protective liner defines a passageway 247 in substantially the center of the blasting nozzle 241. One end of the passageway 247 terminates in a discharge aperture 249. The opposite end of the passageway 247 has a flared or beveled opening 251 that is adjacent the discharge nozzle 233 of the air tip 231.

In operation compressed air will be supplied to the discharge opening 29 of the barrel 5. As previously described. The compressed air will enter the air tip 231 on the sand blasting attachment 225. The air tip will converge the compressed air and discharge it through discharge nozzle 233. The compressed air will then pass into the beveled opening 251 on the passageway 247 and be discharged from the sand blasting attachment through aperture 249 in the end of the blasting nozzle 241. As the compressed air exits the discharge nozzle 233 and enters the passageway 247 it will create a zone of reduced pressure in the chamber 235. The region or reduced pressure will create a reduced pressure in aperture 237 so that sand or other abrasive material can be drawn into the chamber 235 through the aperture 237 from a container (not shown). The sand or abrasive material will be drawn into the beveled opening 251 for the passageway 247 as the sand is entrained in the compressed air. The compressed air will act as the carrying fluid for the sand or abrasive material and will cause the sand to be discharged from the aperture with a velocity that is suitable for sand blasting. The protective liner 245 is positioned in the blasting nozzle 241 to act as a shield to keep the sand or abrasive material from destroying the interior of the nozzle. The protective liner can be a ceramic material or any other suitable material that can resist the abrasive character of the sand or other particulate material used with the blasting attachment 225.

Figure 7:
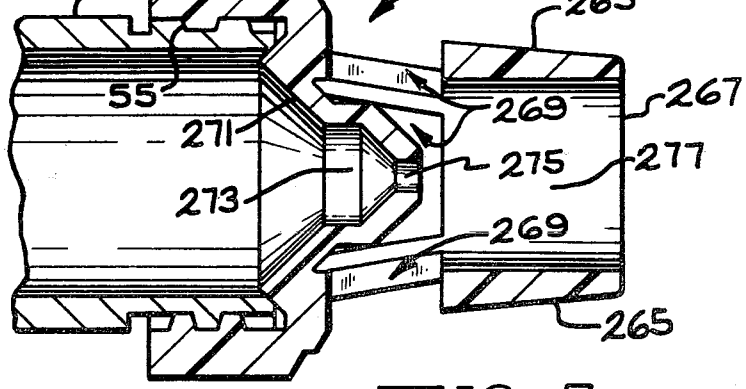
FIG. 7 is a cross sectional view of a duster nozzle attachment that can be utilized with the gun of the present invention.

FIG. 7 shows another attachment which can be used with the previously described gun. A duster nozzle 261 is shown connected to the barrel 5 of the gun. A threaded portion 263 can be provided on the duster nozzle 261 to secure the nozzle to the threaded connection 55 on the barrel 5 of the gun. The walls 265 of the nozzle 261 define a discharge opening 267 in the end of the duster nozzle. Apertures 269 can be provided in the walls 265.

The interior of the duster nozzle 261 is provided with generally converging walls 271 that form a nozzle 273 having a discharge aperture 275. The nozzle 273 and discharge aperture 275 provide a path of communication between the interior of the barrel 5 and the chamber 277 that is positioned in the duster nozzle 261 adjacent the discharge opening 267.

In operation compressed air will be supplied to the barrel 5 of the gun in the manner previously described. The compressed air will be directed into the nozzle 273 by the generally converging sidewalls 271 positioned in the interior of the duster nozzle 261. The compressed air will continue to be converged in the nozzle 273 until it passes through discharge aperture 275 into chamber 277. As the compressed air converges to move through the nozzle and discharge aperture 275 the velocity of the compressed air will be increased. Thus, the compressed air entering chamber 277 will be at a higher velocity than the compressed air in the barrel 5 of the gun. The high velocity compressed air will be discharged through discharge opening 267 and can be used to remove or move particulate material. As the high velocity compressed air moves through the chamber 277 an area of reduced pressure will be created in the chamber 277. Apertures 269 can be provided in the walls 265 of the duster nozzle 261. The apertures will allow ambient air on the exterior of the duster nozzle 261 to be drawn into the chamber 277 by the reduced pressure in the chamber 277. The ambient air drawn into the chamber will increase the volume of air discharged form the duster nozzle through the discharge opening 267. The apertures 269 also provide a safety release that will allow the compressed air to be discharged from the duster nozzle 261 of the discharge opening 267 becomes plugged for some reason. Thus, the apertures 269 improve the volume of air flow discharged from the discharge nozzle and also provide a safety feature for the duster nozzle.

Figure 8:
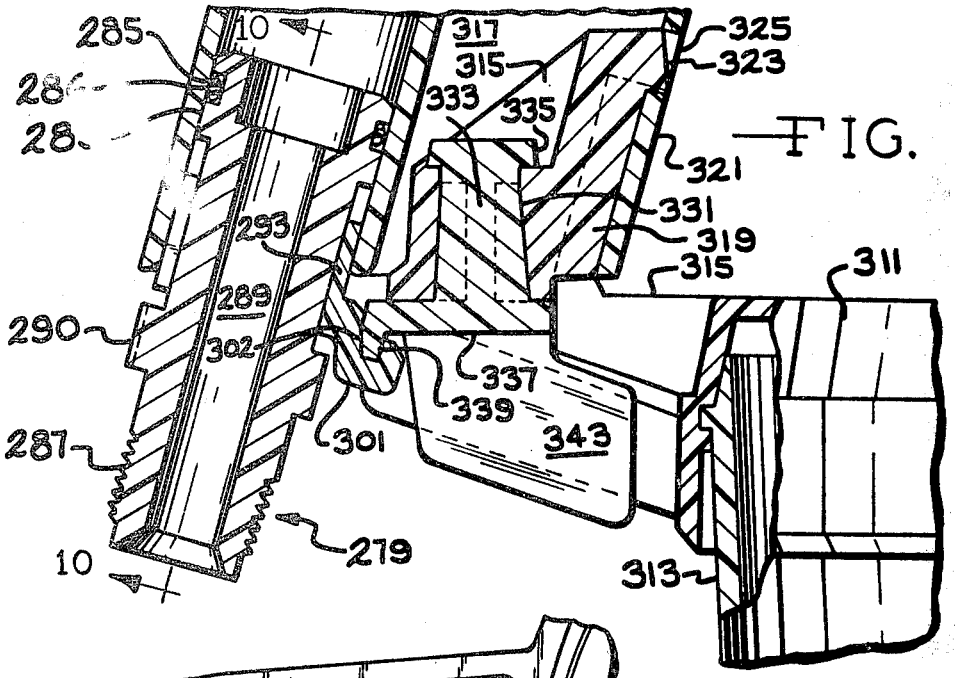
FIG. 8 is a cross sectional view of another embodiment of the present invention.
Figure 10:
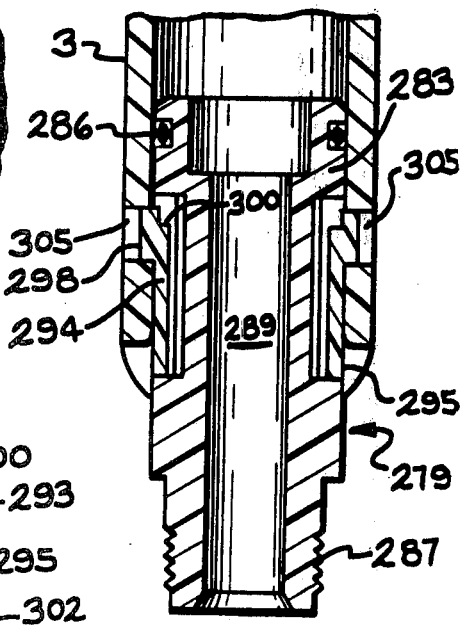
FIG. 10 is a cross sectional view taken along line 10—10 in FIG. 8.
Figure 11:
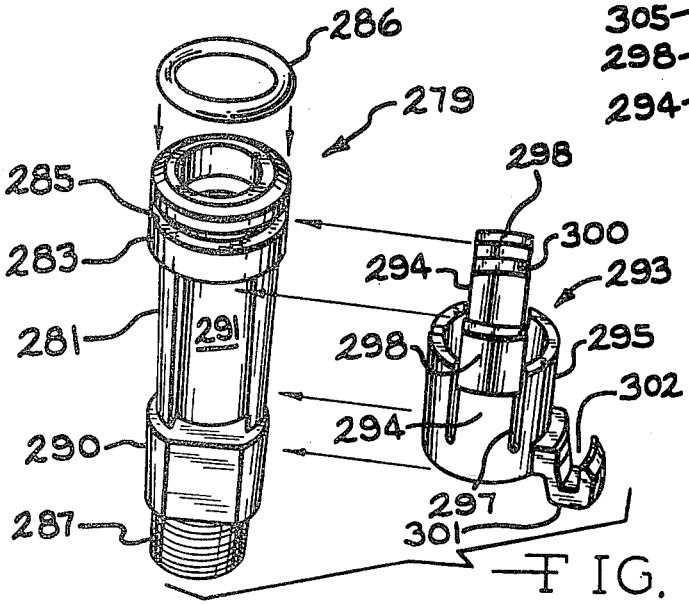
FIG. 11 is a perspective view of an element of the embodiment shown in FIG. 8.

FIGS. 8, 10 and 11 show a connection means 279 that can be used in place of the connector 11 shown in FIG. 1 to connect a supply of compressed air to the handle 3 of the gun. The connection means 279 is rotatably positioned in the passageway 7 located in the handle of the gun. The connection means has a generally cylindrical inner core 281. One end of the inner core has a larger diameter section 283 and the larger diameter section is positioned in the passageway 7. A groove 285 is positioned around the outer periphery of the larger diameter section. An O-ring seal 286 can be positioned in the groove 285 to provide a tight seal between the enlarged diameter section 283 and the side walls of the handle 3. The other end of the inner core 281 has a threaded section 287 to which a source of compressed fluid can be connected. A passageway 289 passes through the center of the inner core and places the passageway 7 in the handle 3 in communication with the source of compressed fluid that is connected to the inner core 281 at the threaded section 287. Positioned on the outer periphery of the inner core 281 are stops 290. The stops are positioned on the portion of the inner core 281 that is spaced apart from the handle 3 of the gun. The stops 290 extend from the surface of the inner core 281 a distance that is sufficient for the stops to engage the outer periphery of the walls of the handle 3 to prevent the inner core from being advanced too far into the passageway 7 in the handle 3. The portion of the inner core 281 located between the larger diameter section 283 and the stops 290 contains cutout sections 291 that are located on opposite sides of the inner core.

A removeable clip 293 is positioned around the inner core 281 in the region located between the larger diameter section 283 and the stops 290. The clip fits loosely around the inner core and the inner core is usually free to rotate with respect to the clip. The clip usually contains a split or break in one portion to allow the clip to be opened up to fit around the inner core. The clip has pivotally mounted flanges 294 positioned on opposite sides of the clip. The flanges extend from the base 295 of the clip and the flanges are substantially parallel to the sides of the inner core 281. Slots 297 are positioned along the sides of the flanges in the base 293 to improve the pivotal movement of the flanges. The flanges are positioned on the clip 293 so that the flanges can be pivoted and positioned in the cutout sections 291 on the inner core 281 of the connection means 279. The ends of the flanges 294 that are spaced apart from the base 295 contain projections 298 that extend from the outer periphery of the flanges. A step or shoulder 300 is located on the interior of the flange where the projection 298 joins the flange 294.

The removeable clip 293 also contains a tab 301 that projects from one side of the clip. The tab 301 has a substantially U-shaped configuration and defines a U-shaped groove 302.

When the connection means 279 is positioned in the passageway 7 in the handle 3 the projections 298 on the flanges 294 engage the apertures 305 located on opposed sides of the handle 3. The engagement between the projections 298 and the apertures 305 removeably engages the connection means 279 with the handle 3 of the gun.

To install the connection means 279 in the handle 3 of the gun the flanges 294 on the clip 293 are positioned in alignment with the cutout sections 291 on the inner core 281. In this position the flanges 294 are displaced or pivoted inwardly into the cutout sections 291 to allow the projections 298 to pass into the passageway 7 in the handle 3. When the projections 298 come into alignment with the apertures 305 the flanges pivot outwardly to their normal position and the projections 298 are positioned in engagement with the apertures 305. Once the flanges 294 extend outwardly to their normal positions the flanges are no longer positioned in engagement with the cutout sections 291. When the flanges are not in engagement with the cutout sections the inner core 281 is free to rotate with respect to the removeable clip 293. Since the inner core is free to rotate the inner core 281 can form a pivotal connection between the gun and the source of compressed fluid which is attached to the threaded section 287 on the inner core 281. The O-ring seal 286 provides a tight seal between the inner core 281 and the chamber 7 in the handle 3.

To remove the connection means 279 from the handle 3 of the gun the inner core 281 must be rotated until the cutout sections 291 are in alignment with the flanges 295. Suitable alignment indicators can be provided on the inner core 281 and the removeable clip 293 to facilitate this alignment procedure. When the flanges 294 are in alignment with the cutout sections 291 the flanges can be displaced inwardly into the cutout sections to disengage the projections 298 from the apertures 305 in the handle of the gun. When the projections 298 are disengaged from the apertures 305 the connection means 279 can be withdrawn from the passageway 7 in the handle 3.

A safety means has been provided to help prevent accidental disengagement of the connection means 279 from the gun. When the gun is being used and a source of compressed air is attached to the threaded section 279 the chamber 7 will be pressurized by the pressurized fluid. The pressure in the chamber 7 acts upon the inner core 281 and causes the inner core to move towards the end of the handle 3. The inner core can move towards the open end of the handle 3 until the larger diameter section 283 comes into contact with the step or shoulders 300 where the projections 298 join the flanges 294. When the large diameter section 283 engages the steps 300 the inner core 281 is prevented from further movement towards the end of the handle 3. Thus, during normal operation of the gun the larger diameter section 283 is in engagement with the steps 300 the portion of the projections 289 that extend from the step 300 are in abutting relationship with the larger diameter section 283. The abutting relationship with the larger diameter section prevents the projections 298 and flanges 294 from being displaced into the cutout sections 291 in the inner core 281. Thus, when the gun is being supplied with pressurized fluid the inner core 281 assumes a position with respect to the removeable clip 293 that helps to prevent the connection means 279 from being removed from the gun.

To remove the connection means the supply of pressurized fluid to the gun is terminated and the inner core 281 advanced into the chamber 7 in the handle 3 until the projections 298 no longer engage the larger diameter section 283. The projections 298 can then be disengaged from the apertures 305. This safety feature is designed to help prevent the connection means 279 from being accidentally disengaged from the handle 3 of the gun during the operation of the gun or during the period whem compressed fluid is being supplied to the gun.

Figure 9:
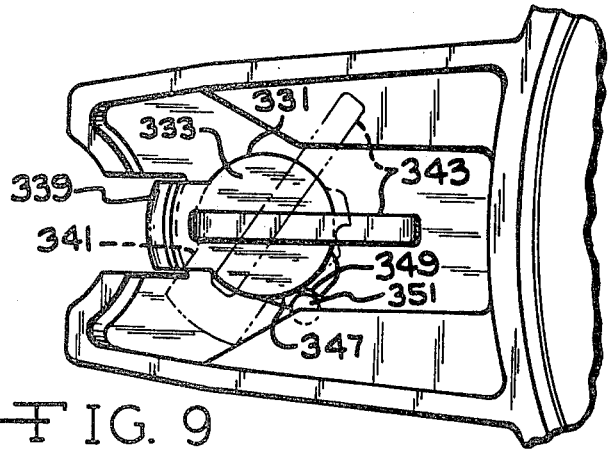
FIG. 9 is a bottom view of the embodiment shown in FIG. 8.

FIGS. 8 and 9 show an embodiment of a securement means that can be used to detachably connect the lid of top 311 of a cup 313 to the handle 3 of a gun. A bracket 315 is connected to the lid 311 of the cup 313. A bracket 315 can be positioned in a cavity 317 located in the handle 3. The bracket 315 is designed to have a section 319 that is in contact with the wall 321 of the handle 3. The section 319 of the bracket 315 contains a projection 323. The projection is positioned to engage an opening 325 in the wall 321 of the handle 3 when the bracket 315 is properly positioned in the cavity 317.

A bore 331 is defined in a portion of the bracket 315. A generally cylindrical member 333 is rotatably positioned in the bore 331. One end of the cylindrical member 333 contains a head 335 having a diameter larger than the diameter of the cylindrical member. The head engages the surface of the bracket 315 adjacent the bore 331. The other end of the cylindrical member contains a rib 337. The rib extends from the cylindrical member 333 in a direction that is substantially perpendicular to the cylindrical member. The rib engages the portion of the bracket 315 adjacent the bore 331. On one end of the rib 337 there is a hook 339 that is positioned substantially perpendicular to the main portion of the rib. The hook 339 is positioned to engage the U-shaped groove 302 in the tab 301 on the removeable clip 293. One end of the U-shaped groove 302 has a cut away portion 341 to facilitate positioning the hook 339 in the U-shaped groove.

Connected to the cylindrical member 333 is a flange 343. The flange 343 is connected to the portion of the cylindrical member that extends from the cavity 317 in the handle 3.

The cylindrical member contains a cam surface 347 and a groove 349 positioned on one section of the cylindrical member. A projection 351 is positioned in the bore 331 where the projection can engage the cam surface 347 and the groove 349 on the cylindrical member 333.

The operation of the securement means for the lid 311 will be more fully understood by referring to the attached drawings in connection with the following description. To secure the lid 311 and the cup 313 to the handle 3 the bracket 315 is inserted into the cavity 317 in the handle. The section 319 on the bracket is positioned against the wall 321 of the handle with the projection 323 positioned in the opening 325. As the bracket 315 is positioned in the cavity 317 the rib 337 will be positioned so that the hook 339 is not in alignment with the U-shaped groove 302 and the tab 301. The broken lines in FIG. 9 show the position of the rib where the hook is not in alignment with the U-shaped groove. When the bracket 315 is properly positioned the flange 343 is rotated to cause the hook 339 on the rib 337 to come into engagement with the U-shaped groove 302. The cut away portion 341 of the U-shaped groove 302 will facilitate the engagement of the hook 339 with the groove. It should also be noted that the cylindrical member 333 will rotate in connection with the rotation of the rib 337.

As the rib 337 and the hook 339 are rotated to place the hook in engagement with the U-shaped groove 302 the cam surface 347 engages the projection 351. When the hook 339 is properly positioned in the groove 302 the cam surface 341 will have moved over the projection 351 and the projection is positioned in groove 349 on the cylindrical member 333. Thus when the hook 339 is in the desired location in engagement with the U-shaped groove 302 the projection 351 will be in engagement with the groove 349. The engagement between the groove 349 and the projection 351 maintains the cylindrical member 333 in this position and, therefore, maintains the hook 339 in engagement with the U-shaped groove 302. To disengage the hook 339 from the groove 302 it is necessary to supply a twisting force to the flange 343 that is sufficient to disengage the projection 351 from the groove 349 and cause the cam surface 347 to pass over the projection 351. Once the hook 339 has been disengaged, the projection 323 can be disengaged from the opening 325 and the bracket 315 removed from the cavity 317 in the handle 3. The force required to disengage the groove 349 from the projection 351 and cause the cam surface 347 to pass over the projection is sufficient to prevent accidental disengagement of the hook 339 from the U-shaped groove 302. Therefore, the projection 351, cam surface 347 and groove 349 act to maintain the cylindrical member 333, the bracket 315 and the cup 313 in the proper location with respect to the handle during the operation of the gun.

When the bracket 315 and cylindrical member 333 are properly positioned the projection 323 is secured in the opening 325 and the hook 339 is secured in the U-shaped groove 302. The projection and hook provide support to securely attach the bracket 315 and cylindrical member 333 to the handle 3 of the gun. Since the lid 311 and cup 313 are also secured to the bracket 315 the lid and cup are also secured to the handle 3 of the gun.

Having described the invention in detail and with reference to the drawings, it is understood that such specifications are given only for the sake of explanation. Various modifications and substitutes, other than those cited, can be made without departing from the scope of the invention as defined by the following claims.

What I claim is:

1. A paint spray attachment for a gun for supplying a compressed fluid, the gun having a handle, the handle including a cavity, such paint spray attachment comprising, in combination, a hollow adapter, one end of said adapter positioned on the discharge end of said spray gun, the other end of said adapter defining a discharge opening;

an aperture defined in the wall of said adapter;

a passageway positioned in said adapter, said passageway being in communication with said aperture and terminating in a discharge aperture;

a chamber defined in said adapter around said passageway;

an air cap positioned on such other end of said adapter;

at least one fluid aperture defined in said air cap adjacent said passageway discharge aperture, said fluid aperture being in communication with said chamber;

a cup position in spaced relationship to said adapter;

conduit means between said cup and said adapter aperture;

a bracket for attaching said cup to said gun handle, wherein said bracket is removably positioned in the handle cavity.

2. The paint spray attachment according to claim 1, wherein said air cap defines air shaping apertures in communication with said chamber.

3. The paint spray attachment according to claim 1, wherein said bracket includes a projection that engages said cavity to secure said bracket to the handle of the gun.

4. A paint spray attachment for a gun for supplying a compressed fluid, the gun having a handle, the handle including a cavity, such paint spray attachment comprising:

a substantially cylindrical adapter, one end of said adapter positioned on the discharge end of said spray gun, the other end of said adapter defining a discharge opening;

an aperture defined in said wall of said adapter;

a passageway positioned in said adapter, said passageway being in communication with said aperture in said wall of said adapter, said passageway terminating in a discharge aperture;

a chamber defined in said adapter around said passageway;

an air cap positioned on said other end of said adapter, said air cap extending from the periphery of said adapter to said discharge aperture in said passageway;

at least one aperture disposed in said air cap adjacent said discharge aperture in said passageway, said aperture defining a path of communication between said chamber and said discharge opening of said adapter;

a source of paint in communication with said aperture in said wall of said adapter, said source of paint comprising a cup positioned in spaced apart relationship to said aperture in said wall of said adapter, conduit means between said cup and said adapter aperture, and a bracket for attaching said cup to the handle of the spray gun, wherein said bracket is removably positioned in the handle cavity.

5. The paint spray attachment of claim 4 wherein said passageway is located substantially in the center of said substantially cylindrical adapter.

6. The paint spray attachment of claim 4 wherein a plurality of apertures are disposed in said air cap, said apertures being positioned around and immediately adjacent the periphery of said discharge aperture in said passageway.

7. The paint spray attachment of claim 4 wherein at least one additional aperture is disposed in said air cap in spaced apart relationship to the discharge aperture in said passageway, said additional aperture positioned so that a line projecting from the center of said addition aperture will intersect a line projecting from the center of said discharge aperture in said passageway.

8. The paint spray attachment of claim 7 wherein a plurality of additional apertures are positioned in said air cap adjacent the outer periphery of said air cap.

9. The paint spray attachment of claim 4 wherein a said conduit comprises a hose which extends from said cup to said aperture in said side wall of said adapter.

10. The paint spray attachment of claim 9 wherein a vent is positioned in said cup, said vent being in communication with the interior of said cup and the atmosphere.

11. The paint spray attachment of claim 10 wherein said vent can be connected to an external source of paint for supplying paint to said cup and said paint spray attachment.

12. The paint spray attachment of claim 4 wherein said bracket includes a projection that engages said cavity to secure said bracket to the handle of the gun.

* * * * *